US009854628B2

(12) United States Patent
Imm et al.

(10) Patent No.: US 9,854,628 B2
(45) Date of Patent: Dec. 26, 2017

(54) OVER-THE-RANGE MICROWAVE OVEN AND METHOD OF USING THE SAME

(71) Applicant: Dongbu Daewoo Electronics Corporation, Seoul (KR)

(72) Inventors: Jun Hyuk Imm, Seoul (KR); Jong Jin Lee, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 261 days.

(21) Appl. No.: 14/597,959

(22) Filed: Jan. 15, 2015

(65) Prior Publication Data

US 2016/0165674 A1 Jun. 9, 2016

(30) Foreign Application Priority Data

Dec. 5, 2014 (KR) ..... 10-2014-0174473

(51) Int. Cl.
*H05B 6/80* (2006.01)
*H05B 6/64* (2006.01)
*H05B 6/66* (2006.01)

(52) U.S. Cl.
CPC ..... *H05B 6/6423* (2013.01); *H05B 6/6444* (2013.01); *H05B 6/6458* (2013.01); *H05B 6/664* (2013.01); *H05B 6/666* (2013.01)

(58) Field of Classification Search
CPC .... H05B 6/6423; H05B 6/6458; H05B 6/666; H05B 6/664; H05B 6/6444
USPC ..... 219/757, 756, 681, 685, 716, 717, 723, 219/739, 746; 126/21 R, 21 A, 273 R, 126/197, 299 D, 299 R; 363/17, 98
See application file for complete search history.

(56) References Cited

U.S. PATENT DOCUMENTS

2002/0084265 A1* 7/2002 Ahn ..... H05B 6/6429 219/756
2002/0084267 A1* 7/2002 Kim ..... H05B 6/6423 219/757
2004/0134901 A1* 7/2004 Jeong ..... H05B 6/6429 219/702
2012/0170247 A1* 7/2012 Do ..... H05B 6/6444 362/92

FOREIGN PATENT DOCUMENTS

KR 100305047 B1 * 7/2001
KR 200232522 9/2001
KR 200232523 9/2001
(Continued)

OTHER PUBLICATIONS

Translation of Ji et al (KR20130036415A), Microwave Hood Combination, Apr. 12, 2013, Euroupean Patent Office.*
(Continued)

*Primary Examiner* — Quang Van

(57) ABSTRACT

An over-the-range microwave oven including a duct unit configured to direct air from the back of the oven to the front and further includes an integrated duct module. The duct unit includes: a first panel at the bottom, a pair of second panels forming both lateral side surfaces of the duct unit. Water vapor generated from food being cooked flows along an enclosed flow path and thus is unaffected by the exhaust air flow. A humidity sensor is disposed on the first panel and operable to detect water vapor in the cooking unit.

12 Claims, 5 Drawing Sheets

(56) References Cited

FOREIGN PATENT DOCUMENTS

| | | | | |
|---|---|---|---|---|
| KR | 100807384 | B1 | | 2/2008 |
| KR | 1020110063929 | A | | 6/2011 |
| KR | 20130036415 | A | * | 4/2013 |

OTHER PUBLICATIONS

Korean Intellectual Property Office; Office Action issued in counterpart Korean Application No. 10-2014-0174473; dated Nov. 17, 2015; Korea.

* cited by examiner

OVER-THE-RANGE MICROWAVE OVEN AND METHOD OF USING THE SAME

CROSS-REFERENCE TO RELATED APPLICATIONS

This application claims benefit and priority to Korean Patent Application No. 10-2014-0174473, filed on Dec. 5, 2014, with the Korean Intellectual Property Office, the disclosure of which is incorporated herein in its entirety by reference.

TECHNICAL FIELD

Embodiments of the present disclosure relate to over-the-range microwave ovens, and more specifically, relate to humidity sensing mechanisms of over-the-range microwave ovens.

BACKGROUND

In general, an over-the-range microwave oven refers to a microwave oven equipped with a venting system for exhausting heat, air and/or fumes during cooking. An over-the-range microwave oven is usually mounted above a gas or electric range.

That is, a typical over-the-range microwave oven may include a cooking unit and a duct unit. The cooking unit is used to heat food or liquid (hereinafter, collectively referred to as food) placed therein using microwave energy.

During microwave cooking, water vapor is generated from the food being heated. The humidity of food can be sensed by a humidity sensor in the microwave. The sensed humidity may be utilized for controlling the operation of the cooking unit.

Usually, a humidity sensor is installed on the upper side of the cooking unit and operates to sense of the amount of water vapor inside the cooking unit.

However, because the motion of water vapor generated from food tends to be affected by the air flow induced by the air discharge unit of the microwave oven, the information sensed by the humidity sensor cannot accurately reflect the cooking condition of the food or the working condition of the cooking unit.

SUMMARY

Embodiments of the present disclosure are directed to providing an over-the-range microwave oven that can sense the humidity inside the cooking unit with enhanced accuracy.

An exemplary embodiment of the present disclosure provides an over-the-range microwave oven design including: a housing; a cooking unit which is disposed in the housing; a duct unit which is disposed in the housing; a first panel which divides the duct unit into an upper duct and a lower duct; at least a pair of second panels which forms both lateral side surfaces of the upper duct; and a humidity sensor which is disposed on the first panel.

In addition, the housing may include a partition wall which vertically partitions the interior of the housing into the cooking unit and the duct unit and has a water vapor discharge portion through which water vapor flows out of the cooking unit. The duct unit may include an upper duct unit which is disposed between the housing and the cooking unit and is located on an upper side of the cooking unit, the first panel may be spaced apart from an upper side of the partition wall and may form a bottom surface of the upper duct unit. The duct unit may further include the second panels disposed between the first panel and the housing which form the lateral side surfaces of the upper duct unit. An interval or a gap between the second panels decreases along an air flow direction. A humidity sensor may be disposed on the first panel so as to be spaced apart from one of the second panels.

In addition, the over-the-range microwave oven may include: a third panel which is disposed on the rear side of the pair of second panels and has an inlet hole into which air flows; and a fourth panel which is disposed outside one panel of the pair of second panels.

One of the second panels and the fourth panel may extend to enclose a portion between the first panel and the partition wall.

The humidity sensor may be disposed in a space defined by one of the second panels and the fourth panel.

In addition, the pair of second panels may include: a pair of first horizontal portions which is disposed at both sides of the third panel, respectively, and parallel with each other; a pair of inclined portions which is extended from the pair of first horizontal portions, respectively, and that has an interval or a gap therebetween that is gradually decreased; and a pair of second horizontal portions which is extended from the pair of inclined portions, respectively, and parallel with each other.

In addition, the fourth panel may be disposed so that a space formed by the fourth panel, the inclined portion, and the second horizontal portion is symmetric in shape.

In addition, a space (which is defined by one of the second panels and the fourth panel) may be formed above the water vapor discharge portion.

In addition, the humidity sensor may be disposed above the water vapor discharge portion.

Another exemplary embodiment of the present disclosure provides an over-the-range microwave oven including: a housing which includes a partition wall which vertically partitions the interior of the housing into a cooking unit and a duct unit and has a water vapor discharge portion through which water vapor flows out of the cooking unit; the cooking unit which is disposed in the housing; the duct unit which includes an upper duct unit which is disposed between the housing and the cooking unit and is disposed at an upper side of the cooking unit; a first panel which is spaced apart from an upper side of the partition wall and forms a bottom surface of the upper duct unit; a pair of second panels which is disposed between the first panel and the housing to form lateral side surfaces of the upper duct unit and formed such that an interval or a gap therebetween is decreased in a direction from a portion (into which air flows) toward a portion where air is discharged; and a duct module which includes a humidity sensor that is disposed on the first panel, disposed outside the pair of second panels, and disposed on the first panel so as to be spaced apart from one of the second panels.

The over-the-range microwave oven may include: a third panel which is disposed at the rear of the pair of second panels and has an inlet hole into which air flows; and a fourth panel which is disposed outside one of the pair of second panels.

One of the second panels and the fourth panel may extend to enclose a portion between the first panel and the partition wall.

The humidity sensor may be disposed in a space defined by one of the second panels and the fourth panel.

The pair of second panels may include: a pair of first horizontal portions which is disposed at both sides of the third panel, respectively, and parallel with each other; a pair of inclined portions which is extended from the pair of first horizontal portions, respectively, and has an interval or gap therebetween that is gradually decreased; and a pair of second horizontal portions which is extended from the pair of inclined portions, respectively, and parallel with each other.

The duct module may include: a power source unit which is disposed on the first panel outside one of the first horizontal portions; a running capacitor which is disposed on the first panel outside one of the inclined portions; a noise filter which is disposed on the first panel outside one of the second horizontal portions; and a fuse which is disposed on the first panel outside the other first horizontal portion.

The duct module may further include a lighting unit which is disposed on a lower surface of the first panel. The partition wall may have a light entering portion through which light from the lighting unit enters the cooking unit.

A filter may be disposed on the pair of second horizontal portions.

The over-the-range microwave oven may further include an air discharge unit which is disposed between the third panel and a rear surface of the housing and allows air to flow to the duct unit.

In addition, the air discharge unit may include an air discharge motor, and an impeller which is operated by the air discharge motor and allows air to flow to the duct unit.

In addition, the third panel may include a first inlet hole, and a second inlet hole, and the impeller may include a first impeller which is disposed at one side of the air discharge motor to allow air to flow into the first inlet hole, and a second impeller which is disposed at the other side of the air discharge motor to allow air to flow into the second inlet hole.

The third panel may further include a bent portion which protrudes forward between the first inlet hole and the second inlet hole.

Yet another exemplary embodiment of the present invention provides a method of using an over-the-range microwave oven, including: operating an air discharge unit; and discharging air, by using the discharge unit, around a gas range or discharging air flowing by a drive unit of a microwave oven through an upper duct unit, which is disposed between a housing and a cooking unit and forms a flow path, the duct unit including a first panel which is disposed at an upper side of the cooking unit, a pair of second panels which is disposed between the first panel and the housing and disposed symmetrically so that an interval or a gap therebetween is decreased toward the front side, and a third panel which is disposed at the rear of the pair of second panels and has inlet holes into which air flows. An operational state of the cooking unit is controlled in accordance with humidity sensed by a humidity sensor disposed on the first panel.

The present disclosure improves ventilation efficiency and air flow efficiency by improving the duct flow path. The duct module integrates the associated electrical components in a compact manner, which improves space usage efficiency of the oven, reduces assembly tolerance, improves manufacturing productivity, improves durability, and facilitates development of compact style over-the-range ovens.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
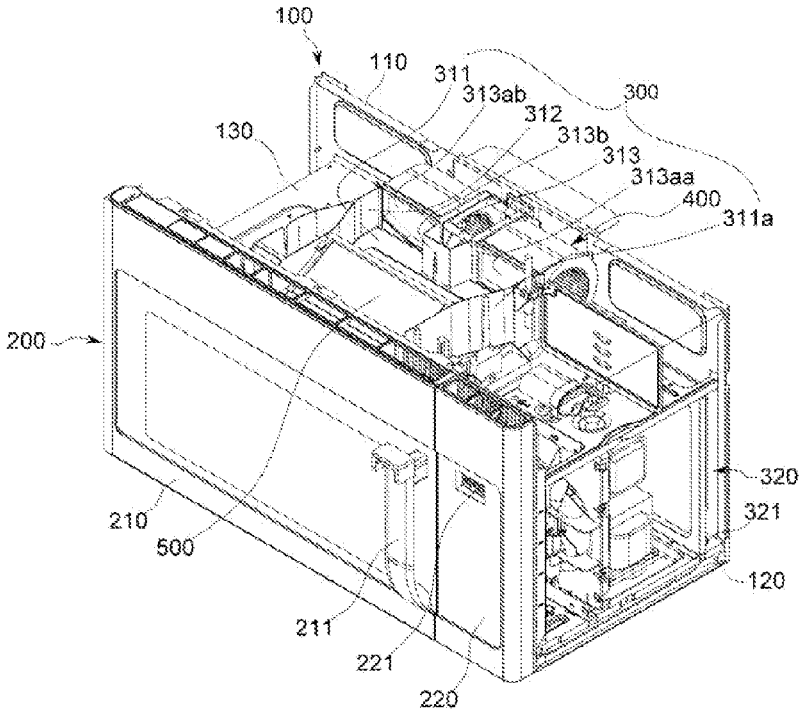
FIG. 1 illustrates the configuration of an exemplary over-the-range microwave oven design according to an embodiment of the present disclosure.

In the following detailed description, reference is made to the accompanying drawing, which forms a part hereof. The illustrative embodiments described in the detailed description, drawing, and claims are not meant to be limiting. Other embodiments may be utilized, and other changes may be made, without departing from the spirit or scope of the subject matter presented here.

Hereinafter, an exemplary embodiment of the present disclosure will be described in detail with reference to the accompanying drawings.

Unless particularly defined otherwise, all terms used in the present specification are the same as general meanings of the terms understood by those skilled in the art, and if the terms used in the present specification conflict with general meanings of the corresponding terms, the meanings of the terms comply with the meanings defined in the present specification.

However, the present disclosure, which is disclosed below, is intended to merely describe the exemplary embodiment of the present disclosure, but is not intended to limit the scope of the present disclosure, and like reference numerals designate like elements throughout the specification.

Figure 2:
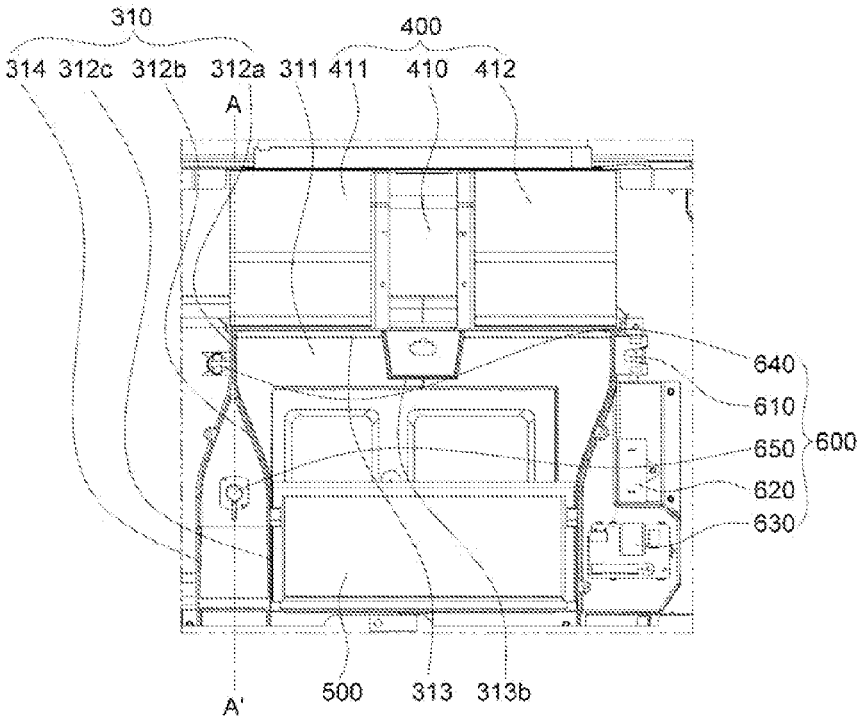
FIG. 2 illustrates a top view of an exemplary first panel on which a duct module is mounted according to an embodiment of the present disclosure.
Figure 3:
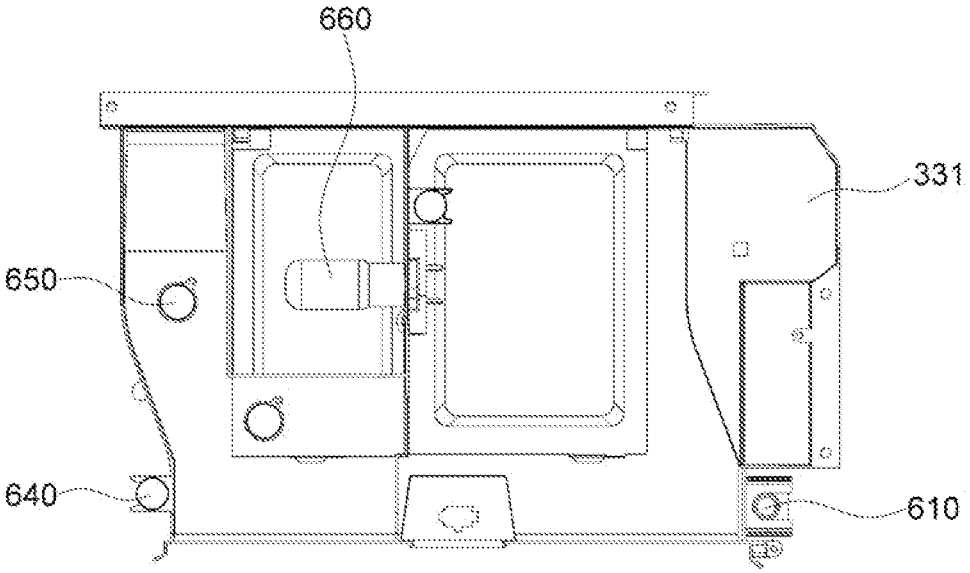
FIG. 3 illustrates the first panel illustrated in FIG. 2 viewed from the lower side thereof.
Figure 4:
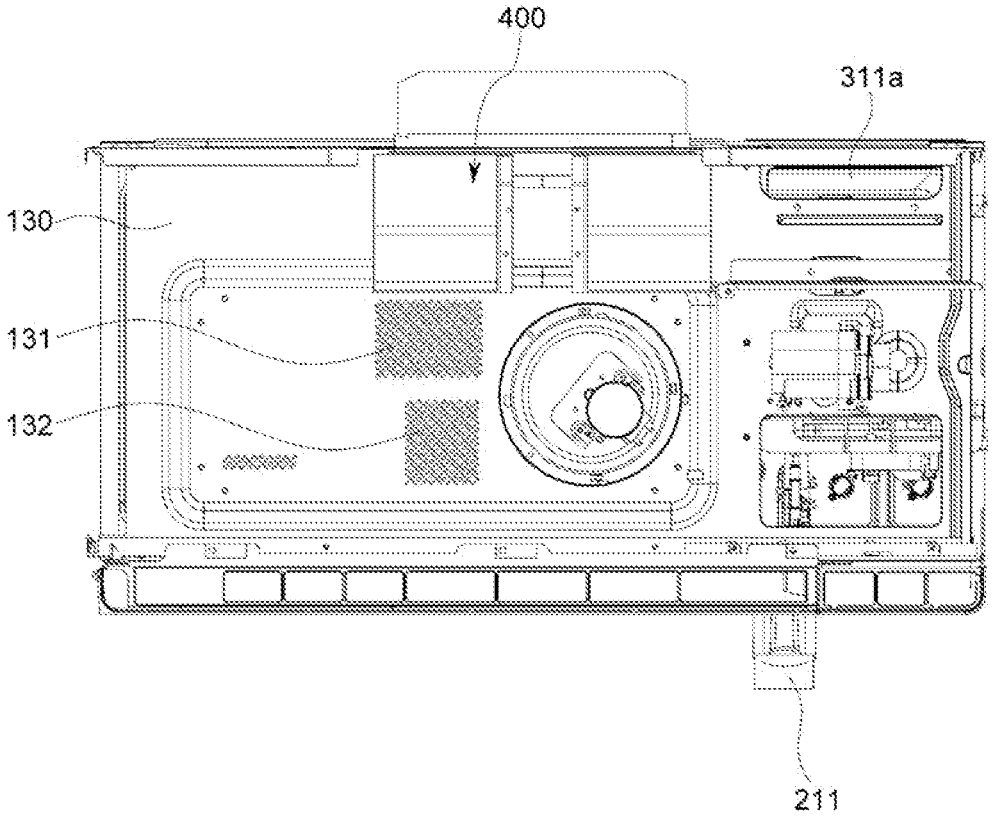
FIG. 4 illustrates a view with the upper duct unit illustrated in FIG. 2 removed.
Figure 5:
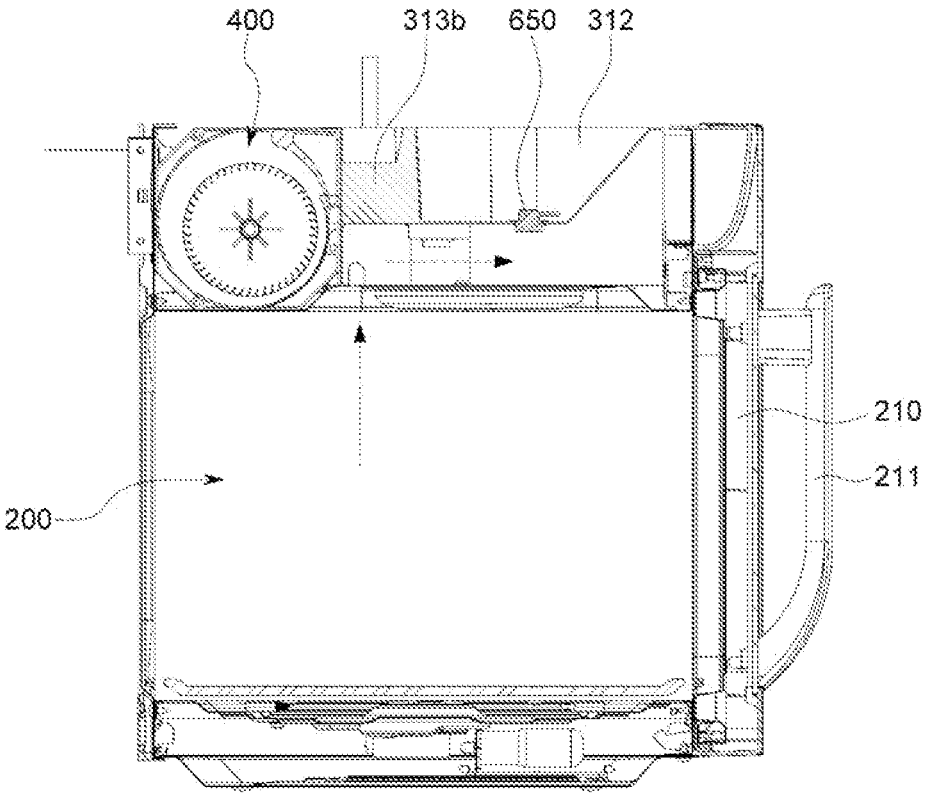
FIG. 5 is a cross-sectional view of an exemplary over-the-range microwave oven according to an embodiment of the present disclosure taken along line A-A' of FIG. 2.

FIG. 1 illustrates a perspective view of an exemplary over-the-range microwave oven according to an embodiment of the present disclosure in which an upper housing and a lateral side housing are removed. FIG. 2 is a top view of a first panel on which a duct module is mounted according to the exemplary embodiment of the present disclosure. FIG. 3 is a view of the first panel illustrated in FIG. 2 viewed from the lower side thereof. FIG. 4 is a view in which an upper duct unit illustrated in FIG. 2 is removed. FIG. 5 is a cross-sectional view of an exemplary over-the-range microwave oven according to an embodiment of the present disclosure taken along line A-A' of FIG. 2.

Referring to FIGS. 1 and 2, the microwave oven includes a housing 100, a cooking unit 200, a duct unit 300, an air discharge unit 400, and a duct module 600, and may further include a filter unit 500.

The housing 100 defines the exterior of the over-the-range microwave oven, and may be made of a metal or nonmetal material. The housing 100 may include an upper cover and a lateral side cover (not illustrated), a rear cover 110 and a lower cover 120. The respective covers 100 may be integrally formed or may be detachably coupled to each other.

In addition, the housing 100 further includes a partition wall 130 which may vertically partition the interior of the housing 100 into the cooking unit 200 and the duct unit 300. The partition wall 130 may be formed integrally with the housing 100, or may be fastened to the housing 100, e.g., by bolting.

Here, the partition wall 130 may have a water vapor discharge portion 131 through which water vapor flows out of the cooking unit 200, and a light entering portion 132 through which light generated from a lighting unit 660 enters the cooking unit 200, as described below.

The water vapor discharge portion 131 or the light entering portion 132 may be formed by drilling a plurality of holes into the partition wall 130. In particular, in the case in which the light entering portion 132 includes a plurality of holes, the light entering portion 132 may be covered by glass or a transparent film such that all of the water vapor generated in the cooking unit 200 will flow into the water vapor discharge portion 131.

In addition, the housing 100 may be formed as an outer wall of the duct unit 300 as described below.

The cooking unit 200 is disposed in the housing 100, and may include a cooking chamber, and an electric equipment chamber.

The door 210 is disposed in the front of the cooking chamber. The door 210 may be hingedly coupled to the housing 100. A handle 211 may be disposed on the door 210 which allows a user to easily open and close the door 210. In addition, in order to allow the user to easily view the interior of the cooking chamber, the door 210 may further include a transparent window 212, e.g., made of tempered glass, etc.

In addition, the cooking unit 200 may include a control panel 220 disposed on one side of the door 210. The control panel 220 may include input mechanisms (such as buttons, a touch panel, or a dial) for users to control the cooking unit 200. The control panel 220 may include a display unit 221 for presenting information to users related to the operations of the over-the-range microwave oven.

In addition, the control panel 220 may include buttons, a touch panel, or a dial, which allow the user to control the operations of the duct unit 300 and the cooking unit 200. The state of the interior of the cooking unit 200 can be sensed by a humidity sensor 650 as described below.

The duct unit 300 may be disposed between the housing 100 and the cooking unit 200 and forms an air flow path. In this example, the duct unit 300 is divided into an upper duct unit 300 and a lateral side duct unit 320.

The lateral side duct unit 320 is disposed between the cooking unit 200 and the side cover (not illustrated) or may be disposed between the control panel 220 and the side cover (not illustrated). In this case, the housing 100 serves as the outer wall of the duct unit 300.

Here, the lateral side duct unit 320 includes a first inlet port 321 having an opening at the lower cover 120 for accepting air from the outside of the oven. The lateral side duct unit 320 guides air flowing from the first inlet port 321 to the upper duct unit 300. A plurality of first inlet ports 321 may be formed similarly.

The upper duct unit 310 is disposed on an upper side of the cooking unit 200 and may include a first panel 311, second panels 312, and/or a third panel 313, and may further include a fourth panel 314.

By use of the upper duct unit 300, an air discharge flow path (or the exhaust path) from the rear side towards the front side is formed. Thus, a range hood and an over-the-range microwave oven according to the present disclosure may advantageously reduce turbulent air flows, electric power consumption, and noise level.

The first panel 311 divides the duct unit 300 into an upper duct and a lower duct.

More specifically, the first panel 311 may be disposed in the housing 100 to form a bottom surface of the upper duct unit, and may be disposed on an upper side of the cooking unit 200 and on an upper side of the partition wall 130. The first panel 311 may be integrally formed as an upper surface of the partition wall 130. Alternatively, the first panel 311 may be disposed to be spaced apart from the upper side of the partition wall 130. Alternatively, a part of the partition wall 130 may be recessed downward, such that the partition wall 130 may be spaced apart from the first panel 311.

In addition, the first panel 311 includes second inlet ports 311*a* (in the rear side) through which air flowing from the lateral side duct unit 320 flows into the upper duct unit 310. The second inlet ports 311*a* may be formed on both sides of the back of the first panel 311, respectively, and correspond to a first impeller 411 and a second impeller 412 as described below.

The first panel 311 may be made of metal or plastic, for example.

Two second panels 312 are disposed as a pair between the first panel 311 and the housing 100 and form both lateral side surfaces of the upper duct unit, thereby partitioning the interior of the upper duct unit 310.

The gap between the pair of second panels 312 may be designed to decrease along the air flow direction. More specifically, the pair of second panels 312 may be symmetrically disposed and the gap therebetween increasingly narrows toward the front side.

According to the present disclosure, in order to effectively contain water vapor generated from food within he cooking unit such that the humidity sensor 650 can accurately detect humidity therein, one of the pair of second panels 312 may extend downward to enclose a region between the first panel 311 and the partition wall 130.

More specifically, the pair of second panels 312 includes a pair of first horizontal portions 312*a* disposed on both sides of the third panel 313 (as described below) and in parallel to each other. The second panels 312 further include a pair of inclined portions 312*b* extending from first horizontal portions 312*a* and having an increasingly smaller gap. The second panels 312 further include a pair of second horizontal portions 312*c* extending from the inclined portions 312*b* and disposed in parallel to each other.

According to the present disclosure, the air flow path has a symmetrical geometry and becomes narrower toward the front side. The flow path may advantageously improve flow efficiency of the exhaust air or fumes discharged compared to the related art, and may reduce the noise level.

Here, a connecting surface between the first horizontal portion 312*a* and the inclined portion 312*b* (or a connecting surface between the inclined portion 312*b* and the second horizontal portion 312*c* may be tapered or rounded), thereby forming an air discharge flow path offering enhanced ventilation efficiency.

The third panel 313 is disposed in the rear of the pair of second panels 312, and may have inlet holes 313*aa* and 313*ab* for air flow.

That is, referring to FIG. 3, in the air discharge flow path according to the exemplary embodiment, air may pass through the first inlet port 321, the second inlet ports 311*a* and to the impellers 411 and 412 (which redescribed below), and may flow into the inlet holes 313*aa* and 313*ab*. The air flow is then discharged to the outside through a flow path formed by the first panel 311, the second panels 312, and the upper cover 100.

In addition, the third panel 313 may include the first inlet hole 313*aa* directing to the first impeller 411, and the second inlet hole 313*ab* directing to the second impeller 412, thereby effectively enhancing the various air flows.

In addition, the third panel 313 may further include a bent portion 313*b* formed between the first inlet hole 313*aa* and the second inlet hole 313*ab* and protruding forward, thereby further enhancing the air flow.

To prevent the formation of turbulance, the bent portion 313*b* may be increasingly narrower toward the front side. For example, the bent portion 313*b* may have a trapezoidal shape.

The fourth panel 314 may be disposed outside one of the pair of second panels 312. The fourth panel 314 encloses a zone in which the humidity sensor 650 is disposed. Thus, water vapor within the cooking unit 200 is unaffected by air flow that is present outside the cooking unit 200. Thereby, the humidity sensor 650 can accurately sense the humidity within the cooking unit.

In this example, the fourth panel 314 extends downward such that the region between the first panel 311 and the partition wall 130 is enclosed.

Referring to FIG. 5, in the exemplary embodiment having the aforementioned features, the water vapor flow is restricted to the path formed by the cooking unit 200, the water vapor discharge portion 131, the pair of second plates 312, and the fourth plate 314, and a discharge port at the front side.

The air discharge unit 400 is disposed between the third panel 313 and the rear surface of the housing 100, and allows air to flow into the inlet holes 313*aa* and 313*ab*. More specifically, the air discharge unit 400 may include an air discharge motor 410, and the impellers 411 and 412. The impellers 411 412 are driven by the air discharge motor 410 and allow air to flow into the inlet holes 313*aa* and 313*ab*.

Here, the first impeller 411 is disposed on one side of the air discharge motor 410. The second impeller 412 is disposed on the other side of the air discharge motor 410. Both ends of the first impeller 411 and the second impeller 412 are disposed proximate to second inlet ports 311*a*, respectively, thereby allowing air to be pumped from the outside to the inside of the housing 100, to the first panel 311, and to the second panels 312.

According to embodiments of the present disclosure, because the upper duct unit 310 is configured to be narrower toward the front side as described above, the functional components associated with the duct unit 300 may be arranged in a compact manner as a duct module 600.

Here, the duct module 600 may include a power source unit 610, a running capacitor 620, a noise filter 630, and a fuse 640, and may further include the humidity sensor 650 or the lighting unit 660.

The power source unit 610 can be connected to wall power and distribute electric power for operating the cooking unit 200 or the duct unit 300. The power source unit 610 may be disposed on the first panel 311 outside one of the first horizontal portions 312*a*.

The running capacitor 620 (also commonly referred to as a "starting condenser") is used to provide the initial power for activating the air discharge motor 410. The running capacitor 620 may be disposed on the first panel 311 outside one of the inclined portions 312*b*.

The noise filter 630 serves to reduce noise caused by operating the air discharge motor 410, and to provide related signals. The noise filter 430 may be disposed on the first panel 311 outside one of the second horizontal portions 312*c*.

The fuse 640 functions to shut off electric power supplied from the power source unit 610, when an excessive amount of heat (for example, about 90° C. or 150° C.) is generated in the cooking unit 200, or when overheating of the air discharge motor 410 is sensed. The fuse 640 may be disposed on the first panel 311 outside the other first horizontal portion 312*a*.

The humidity sensor 650 may be disposed on the first panel 311. The humidity sensor 650 senses humidity or temperature of water vapor generated from food being cooked in the cooking unit 200. Accordingly, the humidity sensor transmits a signal to a control unit (not illustrated) to control the cooking unit 200 or generating a signal for automatically turning on and off the air discharge motor 410.

The humidity sensor 650 serves to sense humidity of water vapor generated in the cooking unit 200, and generally needs to be disposed above the cooking unit 200. The duct module 600 may be disposed on the first panel 311 outside the other inclined portion 312*b* and the other second horizontal portion 312*c*.

To facilitate the humidity sensor 650 to function properly, the microwave oven may further include the fourth panel 314 disposed on the first panel 311. The combination of the fourth panel 314, the other inclined portion 312*b*, and the other second horizontal portion 312*c* define a symmetric region. The humidity sensor 650 may be disposed within this region.

That is, the humidity sensor 650 may be disposed on the first panel so as to be spaced apart from one of the second panels 312.

More specifically, the humidity sensor 650 may be disposed within a region defined by one of the second panels 312 and the fourth panel 314. This region may be located above the water vapor discharge portion 131. In order to accurately sense a state in the cooking unit 200, the humidity sensor 650 may be disposed above the water vapor discharge portion 131.

Because the duct unit is closed above the water vapor discharge portion 131, the humidity sensor 650 may accurately detect the state of food being cooked in the cooking unit 200. The humidity sensor 650 is coupled to the aforementioned control panel 220 and can provide information used to control the operation of the cooking unit 200.

The lighting unit 660 is disposed on a lower surface of the first panel 311, and allows observation of the interior of cooking unit 200 without opening the door. To this end, the light entering portion 132 may be formed in the partition wall 130 to allow light into the cooking unit 200.

Because the components associated with operating the duct unit are modularized and integrated onto the first panel 311, the related assembly tolerance is advantageously reduced, which can improve manufacturing productivity. The reduced assembly tolerance requirements may also facilitate development of over-the-range microwave ovens of smaller sizes.

Further, the configuration of the duct unit according to the present disclosure enables an accurate detection of the state of the cooking unit 200 by the humidity sensor 650.

The filter unit 500 may be disposed on the front side of the pair of second panels 312, and more specifically, on the second horizontal portion 312*c*. The filter unit 500 may be a charcoal filter and can serve to filter air before it is discharged outside. The filter unit 500 may be detachable.

An exemplary method of using the over-the-range microwave oven design according to an embodiment of the present disclosure will be described below.

First, the air discharge unit 400 is activated when a user provides input through the input means associated with the microwave oven, e.g., the buttons, the touch panel, or the dial disposed on the control panel 220.

Then, the air discharge motor 410 is activated once the external electric power is supplied. The motor 410 drives the impellers 411 and 412 to rotate, and thereby the outside air is drawn to the oven from the first inlet port 321 of the lateral side housing. The drawn air flows into the impellers 411 and 412 through the second inlet ports 311 disposed on the first panel 311.

Thereafter, air flow exits the impellers 411 and 412 at a high speed and enters into a duct through the inlet holes 313*aa* and 313*ab* of the third panel 313. The duct is formed by the housing 100, the first panel 311, and the second 312.

In this example, the bent portion 313*b* formed on the third panel 313 guides the air flow toward the front side and can advantageously prevent the formation of turbulent flow from air exiting the impellers 411 and 412. Because the second panels 312 have a symmetric geometry and form an increasingly narrower gap, air flow can be quickly discharged outside.

The filter is disposed between the second horizontal portions 312*c* and at the the narrowest location of the flow path, thereby effectively capturing and filtering contaminants.

That is, by the operation of the air discharge unit 400, hot air or fumes around a gas or electric range may be discharged or air flowing by a drive unit of a microwave oven may be discharged through the upper duct unit 300. The upper duct unit 300 is disposed between the housing 100 and the cooking unit 200 and serves as a flow path. The upper duct unit includes the first panel 311 disposed on the upper side of the cooking unit 200, the pair of second panels 312 disposed between the first panel 311 and the housing 100. The second panels are disposed symmetrically and a gap therebetween decreases toward the front side. The upper duct unit 300 further includes the third panel 313 disposed in the rear of the pair of second panels 312 and having the inlet holes 313*aa* and 313*ab* for air flow.

Embodiments of the present disclosure employ an air discharge unit 400 disposed on the rear side and configured to guide air from the rear side toward the front side. The air discharge unit 400 includes a symmetric flow path which is increasingly narrower toward the discharge port to further increase the aforementioned effects.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. An over-the-range microwave oven comprising:

a housing defining an exterior;

a cooking unit disposed in the housing;

a duct unit disposed in the housing;

a first panel dividing the duct unit into an upper duct and a lower duct;

a pair of second panels forming lateral sides of the upper duct;

a filter;

a humidity sensor disposed on the first panel, wherein the housing comprises a partition wall vertically partitioning an interior of the housing into the cooking unit and the duct unit, wherein the partition wall comprises a water vapor discharge portion for water vapor flowing out of the cooking unit, wherein the duct unit comprises an upper duct unit disposed between the housing and the cooking unit and is located on an upper side of the cooking unit, wherein the first panel is spaced apart from an upper side of the partition wall and forms a bottom surface of the upper duct unit, wherein the second panels are disposed between the first panel and the housing and form the lateral side surfaces of the upper duct unit, wherein a gap between the second panels decreases in an air flow direction, and wherein further the humidity sensor is disposed on the first panel and spaced apart from one panel of the second panels; and a third panel disposed on a rear side of the pair of second panels and comprising an air inlet hole; and a fourth panel disposed outside one of the pair of second panels, wherein the pair of second panels comprises:

a pair of first horizontal portions respectively disposed on two sides of the third panel and positioned in parallel to each other;

a pair of inclined portions respectively extending from the pair of first horizontal portions, wherein interval gap between the pair of inclined portions gradually decreases; and a pair of second horizontal portions respectively extending from the pair of inclined portions and disposed in parallel to each other, wherein the filter unit is disposed on the pair of second horizontal portion.

2. The over-the-range microwave oven of claim 1, wherein one panel of the second panels and the fourth panel extend to enclose a region between the first panel and the partition wall.

3. The over-the-range microwave oven of claim 2, wherein the humidity sensor is disposed in a region defined by one of the second panels and the fourth panel.

4. The over-the-range microwave oven of claim 1, wherein a region defined by one of the second panels and the fourth panel is located above the water vapor discharge portion.

5. The over-the-range microwave oven of claim 1, wherein the humidity sensor is disposed above the water vapor discharge portion.

6. An over-the-range microwave oven comprising:

a housing comprising a partition wall vertically partitioning an interior of the housing into a cooking unit and a duct unit, wherein the partition wall comprises a water vapor discharge portion for releasing water vapor out of the cooking unit;

the cooking unit disposed in the housing;

the duct unit comprising an upper duct unit that is disposed between the housing and the cooking unit and located on an upper side of the cooking unit;

a first panel located apart from an upper side of the partition wall and forming a bottom surface of the upper duct unit;

a pair of second panels disposed between the first panel and the housing and forming lateral side surfaces of the upper duct unit, wherein a gap between the pair of second panels decreases along an air flow direction;

a duct module comprising a humidity sensor that is disposed on the first panel, wherein the duct module is disposed outside the pair of second panels and is located on the first panel and spaced apart from one of the second panels;

a filter;

a third panel disposed on a rear side of the pair of second panels and comprises an air inlet hole; and a fourth panel disposed outside one of the pair of second panels, wherein the one of the second panels and the fourth panel extends to enclose a region between the first panel and the partition wall, wherein the pair of second panels comprises:

a pair of first horizontal portions respectively disposed on both sides of the third panel and in parallel to each other;

a pair of inclined portions respectively extending from the pair of first horizontal portions, wherein a gap between the a pair of inclined portions gradually decreases; and a pair of second horizontal portions respectively extending from the pair of inclined portions and disposed in parallel with each other, and wherein the filter is disposed on the pair of second horizontal portions.

7. The over-the-range microwave oven of claim 6, wherein the humidity sensor is disposed in a space defined by one of the second panels and the fourth panel.

8. The over-the-range microwave oven of claim 6, wherein the duct module comprises:

a power source unit disposed on the first panel and outside one of the first horizontal portions;

a running capacitor disposed on the first panel and outside one of the inclined portions;

a noise filter disposed on the first panel and outside one of the second horizontal portions; and a fuse which is disposed on the first panel outside the other horizontal portion.

9. The over-the-range microwave oven of claim 6, wherein the duct module further comprises a lighting unit disposed on a lower surface of the first panel, and wherein the partition wall comprises a light entering portion for admitting light generated from a lighting unit into the cooking unit.

10. The over-the-range microwave oven of claim 6 further comprising:

an air discharge unit disposed between the third panel and a rear surface of the housing and configured to draw air from outside the microwave oven into the duct unit.

11. The over-the-range microwave oven of claim 10, wherein the air discharge unit comprises an air discharge motor and an impeller assembly coupled to the air discharge motor, wherein the impeller assembly is configured to pump air to the duct unit.

12. The over-the-range microwave oven of claim 11, wherein the third panel comprises a first inlet hole a second inlet hole, and a bent portion which protruding forward between the first inlet hole and the second inlet hole, and wherein the impeller assembly comprises: a first impeller disposed on a first side of the air discharge motor and configured to push air through the first inlet hole; and a second impeller disposed on a second side of the air discharge motor and configured to push air through the second inlet hole.

* * * * *